US006324366B1

(12) United States Patent
Funayama et al.

(10) Patent No.: US 6,324,366 B1
(45) Date of Patent: Nov. 27, 2001

(54) SLEEVE ROTATION-FEED APPARATUS, DEVELOPING APPARATUS, IMAGE FORMATION APPARATUS, AND FIXATION APPARATUS

(75) Inventors: Yasuhiro Funayama; Tsutomu Uezono, both of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/568,997

(22) Filed: May 11, 2000

(30) Foreign Application Priority Data

May 14, 1999 (JP) ..... 11-134142

(51) Int. Cl.[7] ..... G03G 15/00; G03G 15/08; G03G 15/20

(52) U.S. Cl. ..... 399/159; 399/162; 399/280; 399/288; 399/329

(58) Field of Search ..... 399/159, 162, 399/163, 164, 265, 270, 271, 279, 280, 285, 286, 288, 328, 329, 330, 333

(56) References Cited

U.S. PATENT DOCUMENTS 4,402,593 * 9/1983 Bernard et al. ..... 399/159
4,994,858 * 2/1991 Lubberts ..... 399/164
5,035,197 * 7/1991 Enoguchi et al. ..... 399/280
5,061,963 * 10/1991 Ikegawa et al. ..... 399/280
5,115,279 * 5/1992 Nishikawa et al. ..... 399/330 X
5,875,379 * 2/1999 Machida et al. ..... 399/279 X
6,021,303 * 2/2000 Terada et al. ..... 399/328

FOREIGN PATENT DOCUMENTS 1-234869 9/1989 (JP) .

* cited by examiner

*Primary Examiner*—Sandra Brase
(74) *Attorney, Agent, or Firm*—Ostrolenk, Faber, Gerb & Soffen, LLP

(57) ABSTRACT

A drive roller is rotated and a high voltage periodically alternating between plus and minus based on the potential of a conductive portion of the drive roller 2 is applied by a high voltage power source 4 to an electric charger, so that the surface of the drive roller 2 is charged plus and minus alternately. Since the drive roller 2 is charged, a sleeve 1 is absorbed to and held by the drive roller 2 so as to be rotated and fed together with the drive roller. Moreover, the sleeve 1 is separated from the drive roller 2 by a separator so as to obtain a sag. When the drive roller rotates further, the sleeve 1 is again absorbed to and held by the drive roller 2 charged periodically plus and minus, so as to be rotated together with the drive roller. Thus, the present invention eliminates scratches which may be caused by friction on a developing roller or on a photosensitive body surface and also eliminates contamination with oil.

56 Claims, 7 Drawing Sheets

SLEEVE ROTATION-FEED APPARATUS, DEVELOPING APPARATUS, IMAGE FORMATION APPARATUS, AND FIXATION APPARATUS

BACKGROUND OF THE INVENTION

1. Field of the Invention

The present invention relates to a sleeve rotation-feed apparatus for feeding a thin film sleeve used in an electrophotographic process of development, transfer, and fixation in an electrophotographic copying machine and an electrophotographic printer, and to a developing apparatus, image formation apparatus, and fixation apparatus using this sleeve rotation-feed apparatus.

2. Description of the Related Art

Conventionally, this type of thin film sleeve feeding apparatus is known, for example, in an electrostatic latent image developing apparatus disclosed in Japanese Patent Publication 1-234869.

FIG. 11 shows configuration of a sleeve feeder in this electrostatic latent image developing apparatus.

This electrostatic latent image developing apparatus includes: a drive roller 110 for rotation, a cylindrical thin film member (thin film sleeve) 111 having a circumferential length slightly greater than that of the drive roller 110, a guide member 109 for pressing the thin film member 111 against the drive roller 110, a layer thickness regulating member 112 in pressed contact with the outer surface of the thin film member 111, and the like.

The guide member 109 has an arc-shaped inner surface corresponding to the outer shape of the drive roller 110. Accordingly, this guide member 109 brings the thin film member 111 into contact with the circumference of the drive roller 110, so that a sag of the thin film member 111 is concentrated to an open portion provided against a photosensitive drum 100 of the guide number 109 and a predetermined space S is formed between the drive roller 110 and the thin film member 111. Thus, toner supplied by the layer thickness regulating member 112 to the outer surface of the thin film member 111 is supplied to the outer surface of the photosensitive drum 100 for development of an electrostatic latent image.

Here, assuming $\mu 1$ as a friction coefficient between the outer circumference of the drive roller 110 and the inner circumference of the thin film member 111 and $\mu 2$ as a friction coefficient between the outer circumference of the thin film member 111 and the guide member 109, the relationship $\mu 1 >> \mu 2$ is satisfied. When the drive roller 110 rotates in the direction of the arrow b, the thin film member 111 is also fed in the same direction.

Apart from the aforementioned electrostatic latent image developing apparatus, there is known a sleeve rotation-feed apparatus having the identical configuration used as a photosensitive belt feed apparatus.

That is, in this photosensitive belt feed apparatus, a thin film having a photosensitive function or the like is painted or formed by deposition on a thin film member (thin film sleeve) constituting a photosensitive belt base. A drive roller is arranged inside the loop of this photosensitive belt and a guide member is arranged outside the loop, so that the photosensitive belt is fed in the same way as the configuration shown in FIG. 11.

However, in the aforementioned conventional sleeve rotation-feed apparatus, the respective member materials should be selected so as to satisfy the relationship of friction coefficients as $\mu 1 >> \mu 2$. This reduces flexibility of the design and causes a disadvantage in reducing the cost.

Moreover, since the thin film member 111 is pressed by the guide member 109 or the like against the drive roller 110, scratches may be caused on the outer circumference of the thin film member 111 which is in contact with the guide member 109.

Especially, in the aforementioned photosensitive belt in the feed apparatus, a scratch grows as the operation time increases, resulting in a short service life of the apparatus.

In order to prevent generation of such a scratch, a soft cloth piece may be used to a portion where the guide member is in contact with the thin film member. However, the effect is considered to be small.

Moreover, in the aforementioned conventional apparatus, dusts and toner come into the portion between the thin film member and the drive roller. This lowers the friction force and the sleeve rotation becomes unstable, causing a defective image. On the other hand, in order to rotate at a high speed while suppressing generation of speed irregularities, it is necessary to increase the friction force between the drive roller and the thin film member. For this, the thin film member should be pressed to the drive roller with a greater force. This makes greater the problem of scratch generation on the thin film member. In the conventional apparatus, this has been an obstacle in obtaining a high-speed rotation.

Moreover, when the friction force is increased, the drive torque of the drive roller is increased, increasing the motor size, disabling energy saving.

SUMMARY OF THE INVENTION

It is therefore an object of the present invention to provide a sleeve rotation-feed apparatus capable of feeding a thin film sleeve without using a friction force of a drive roller as well as a developing apparatus, an image formation apparatus, and fixation apparatus using this sleeve rotation-feed apparatus.

In order to achieve the aforementioned object, the sleeve rotation-feed apparatus according to the present invention uses a drive roller for feeding a cylindrical thin film sleeve arranged around the drive roller, the apparatus comprising: a drive roller in which at least roller surface has electroconductivity and a dielectric layer is formed on the conductive roller surface; an electric charger for charging the roller surface of the drive roller; a power source for applying a potential difference between the conductive roller surface of the drive roller and the electric charger; a separator arranged in the proximity of the drive roller for separating the thin film sleeve from the drive roller; and a cylindrical thin film sleeve arranged so as to surround the drive roller, the electric charger, and the separator in such a manner that a portion of the sleeve is in contact with the drive roller, wherein the dielectric layer of the drive roller is used to absorb a portion of the thin film sleeve to a portion of the roller surface, so as to be fed.

In the sleeve rotation-feed apparatus having the aforementioned configuration, an electrostatic absorption force obtained by charging of the dielectric layer of the drive roller is used to absorb a portion of the thin film sleeve to a portion of the roller surface, thus feeding the thin film sleeve. The thin film sleeve is separated from the drive roller by separator arranged at a necessary position, so that the thin film sleeve performs various processes.

Thus, it is possible to feed the thin film sleeve without using a friction force of the drive roller. This enables to eliminate scratches on the thin film sleeve which may be caused by the friction. The material of the drive roller can be selected without considering the friction coefficient.

According to another aspect of the present invention, the sleeve rotation-feed apparatus using a drive roller for feeding a cylindrical thin film sleeve arranged around the drive roller comprises: a drive roller having a roller surface formed by a material of a high resistance and a plurality of linear electrodes extending in axial direction of the roller and arranged in a circumferential direction, wherein every other electrodes constitute an electrode block electrically connected, thus obtaining two of the electric blocks; a power source for applying a potential difference between the two electrode blocks; a separator arranged in the proximity of the drive roller for separating the thin film sleeve from the drive roller; and a cylindrical thin film sleeve arranged so as to surround the drive roller and the separator in such a manner that a portion of the sleeve is in contact with the drive roller, wherein the electrode blocks of the drive roller are used to absorb a portion of the thin film sleeve to a portion of the roller surface, so as to be fed.

In the sleeve rotation-feed apparatus having the aforementioned configuration, an electrostatic absorption force obtained by applying voltage to the electrode block of the drive roller is used to absorb a portion of the thin film sleeve to a portion of the roller surface for feeding the thin film sleeve. The thin film sleeve is separated from the drive roller by the separator arranged at a necessary position, so that various processes are performed by the thin film sleeve.

Accordingly, it is possible to feed the thin film sleeve without using a friction force of the drive roller, eliminating scratches which may be caused by the friction. The roller material can be selected without considering the friction coefficient.

According to still another aspect of the present invention, there is provided a developing apparatus comprising: a sleeve rotation-feed apparatus having a drive roller whose rotation feeds a cylindrical thin film sleeve arranged around the drive roller; toner supplier for supplying toner to a surface of the thin film sleeve; and a doctor blade for regulating a toner layer; the sleeve rotation-feed apparatus including: a drive roller in which at least a roller surface has electro-conductivity and a dielectric layer is formed on the conductive roller surface; an electric charger for charging the roller surface of the drive roller; a power source for applying a potential difference between the conductive roller surface of the drive roller and the electric charger; a separator arranged in the proximity of the drive roller for separating the thin film sleeve from the drive roller; and a cylindrical thin film sleeve arranged so as to surround the drive roller, the electric charger, and the separator in such a manner that a portion of the sleeve is in contact with the drive roller; wherein the dielectric layer of the drive roller is used to absorb a portion of the thin film sleeve to a portion of the roller surface, so as to be fed.

In the developing apparatus having the aforementioned configuration, an electrostatic absorption force obtained by charging of the dielectric layer of the drive roller is used to absorb a portion of the thin film sleeve to a portion of the roller surface, so as to be fed. The thin film sleeve is separated from the drive roller by the separator arranged at a necessary position, so that development and other processes are performed by the thin film sleeve.

Accordingly, it is possible to feed the thin film sleeve without using a friction force of the drive roller, enabling to eliminate scratches which may be caused on the thin film sleeve by friction. The material of the drive roller can be selected without considering the friction coefficient.

According to yet another aspect of the present invention there is provided a developing apparatus comprising: a sleeve rotation-feed apparatus having a drive roller whose rotation feeds a cylindrical thin film sleeve arranged around the drive roller; toner supplier for supplying toner to a surface of the thin film sleeve; and a doctor blade for regulating a toner layer; the sleeve rotation-feed apparatus comprising: a drive roller having a roller surface formed by a material of high resistance and a plurality of linear electrodes extending in axial direction of the roller and arranged in a circumferential direction, wherein every other electrodes constitute an electrode block electrically connected, thus obtaining two of the electric blocks; a power source for applying a potential difference between the two electrode blocks; a separator arranged in the proximity of the drive roller for separating the thin film sleeve from the drive roller; and a cylindrical thin film sleeve arranged so as to surround the drive roller and the separator in such a manner that a portion of the sleeve is in contact with the drive roller; wherein the electrode blocks of the drive roller are used to absorb a portion of the thin film sleeve to a portion of the roller surface, so as to be fed.

In the developing apparatus having the aforementioned configuration, an electrostatic absorption force obtained by applying voltage to the electrode blocks of the drive roller is used to absorb a portion of the thin film sleeve to a portion of the roller surface, so as to be fed. The thin film sleeve is separated from the drive roller by the separator arranged at a necessary position, so that development and other processes are performed by the thin film sleeve.

Accordingly, it is possible to feed the thin film sleeve without using a friction force of the drive roller, enabling to eliminate scratches which may be caused on the thin film sleeve by friction. The material of the drive roller can be selected without considering the friction coefficient.

According to yet another aspect of the present invention, there is provided an image formation apparatus comprising: a sleeve rotation-feed apparatus having a drive roller whose rotation feeds a cylindrical thin film sleeve arranged around the drive roller and having a photosensitive layer on its outer surface, the sleeve rotation-feed apparatus including: a drive roller in which at least a roller surface has electro-conductivity and a dielectric layer is formed on the conductive roller surface; an electric charger for charging the roller surface of the drive roller; a power source for applying a potential difference between the conductive roller surface of the drive roller and the electric charger; a separator arranged in the proximity of the drive roller for separating the thin film sleeve from the drive roller; and a cylindrical thin film sleeve arranged so as to surround the drive roller, the electric charger, and the separator in such a manner that a portion of the sleeve is in contact with the drive roller; wherein the dielectric layer of the drive roller is used to absorb a portion of the thin film sleeve to a portion of the roller surface, so as to be fed.

In the image formation apparatus having the aforementioned configuration, an electrostatic absorption force obtained by charging of the dielectric layer of the drive roller is used to absorb a portion of the thin film sleeve to a portion of the roller surface, so as to be fed. The thin film sleeve is separated from the drive roller by the separator arranged at a necessary position, so that image formation and other processes are performed o n the thin film sleeve. Accordingly, it is possible to feed the thin film sleeve without using a friction force of the drive roller, enabling to eliminate scratches which may be caused on t he thin film sleeve by friction. The material of the drive roller can be selected without considering the friction coefficient.

According to still yet another aspect of the present invention there is provided an image formation apparatus comprising: a sleeve rotation-feed apparatus having a drive roller whose rotation feeds a cylindrical thin film sleeve arranged around the drive roller and having a photosensitive layer on its outer surface, the sleeve rotation-feed apparatus including: a drive roller having a roller surface formed by a material of a high resistance and a plurality of linear electrodes extending in axial direction of the roller and arranged in a circumferential direction, wherein every other electrodes constitute an electrode block electrically connected, thus obtaining two of the electric blocks; a power source for applying a potential difference between the two electrode blocks; a separator arranged in the proximity of the drive roller for separating the thin film sleeve from the drive roller; and a cylindrical thin film sleeve arranged so as to surround the drive roller and the separator in such a manner that a portion of the sleeve is in contact with the drive roller; wherein the electrode blocks of the drive roller are used to absorb a portion of the thin film sleeve to a portion of the roller surface, so as to be fed.

In the image formation apparatus having the aforementioned configuration, an electrostatic absorption force obtained by applying voltage to the electrode blocks of the drive roller is used to absorb a portion of the thin film sleeve to a portion of the roller surface, so as to be fed. The thin film sleeve is separated from the drive roller by the separator arranged at a necessary position, so that image formation and other processes are performed to the thin film sleeve.

Accordingly, it is possible to feed the thin film sleeve without using a friction force of the drive roller, enabling to eliminate scratches which may be caused on the thin film sleeve by friction. The material of the drive roller can be selected without considering the friction coefficient.

According to yet another aspect of the present invention, there is provided a fixation apparatus comprising: a sleeve rotation-feed apparatus having a drive roller whose rotation feeds a cylindrical thin film sleeve arranged around the drive roller, the sleeve rotation-feed apparatus including: a drive roller in which at least a roller surface has electroconductivity and a dielectric layer is formed on the conductive roller surface; a heater arranged in the drive roller for heating the roller surface of the drive roller; an electric charger for charging the roller surface of the drive roller; a power source for applying a potential difference between the conductive roller surface of the drive roller and the electric charger; a separator arranged in the proximity of the drive roller for separating the thin film sleeve from the drive roller; and a cylindrical thin film sleeve arranged so as to surround the drive roller, the electric charger, and the separator in such a manner that a portion of the sleeve is in contact with the drive roller; wherein the dielectric layer of the drive roller is used to absorb a portion of the thin film sleeve to a portion of the roller surface, so as to be fed.

In the fixation apparatus having the aforementioned configuration, an electrostatic absorption force obtained by charging of the dielectric layer of the drive roller is used to absorb a portion of the thin film sleeve to a portion of the roller surface, so as to be fed. The thin film sleeve is separated from the drive roller by the separator arranged at a necessary position, so that fixation and other processes are performed onto a recording medium.

Accordingly, it is possible to feed the thin film sleeve without using a friction force of the drive roller, enabling to eliminate scratches which may be caused on the thin film sleeve by friction. The material of the drive roller can be selected without considering the friction coefficient.

According to still another aspect of the present invention, there is provided a fixation apparatus comprising: a sleeve rotation-feed apparatus having a drive roller whose rotation feeds a cylindrical thin film sleeve arranged around the drive roller, the sleeve rotation-feed apparatus including: a drive roller having a roller surface formed by a material of a high resistance and a plurality of linear electrodes extending in axial direction of the roller and arranged in a circumferential direction, wherein every other electrodes constitute an electrode block electrically connected, thus obtaining two of the electric blocks; a power source for applying a potential difference between the two electrode blocks; a separator arranged in the proximity of the drive roller for separating the thin film sleeve from the drive roller; and a cylindrical thin film sleeve arranged so as to surround the drive roller and the separator in such a manner that a portion of the sleeve is in contact with the drive roller; wherein the electrode blocks of the drive roller are used to absorb a portion of the thin film sleeve to a portion of the roller surface, so as to be fed.

In the fixation apparatus having the aforementioned configuration, an electrostatic absorption force obtained by applying voltage to the electrode blocks of the drive roller is used to absorb a portion of the thin film sleeve to a portion of the drive roller, so as to be fed. The thin film sleeve is separated from the drive roller by the separator arranged at a necessary position, so that fixation and other processes are performed onto a recording medium.

Accordingly, it is possible to feed the thin film sleeve without using a friction force of the drive roller, enabling to eliminate scratches which may be caused on the thin film sleeve by friction. The material of the drive roller can be selected without considering the friction coefficient.

DESCRIPTION OF THE PREFERRED EMBODIMENTS

Hereinafter, explanation will be given on a sleeve rotation-feed apparatus, a developing apparatus, an image formation apparatus, and a fixation apparatus according to an embodiment of the preset invention. The sleeve rotation-feed apparatus according to the embodiment is an apparatus for feeding a cylindrical thin film member (sleeve) and includes: a rotatable drive roller having a dielectric layer on the roller surface; an electric charger for charging the surface of the drive roller; a power source for providing a potential difference between the conductive portion of the drive roller and the electric charger; and separator arranged in the proximity of the drive roller, wherein the thin film member is arranged to surround the drive roller, the electric charger, and the separator, so that the thin film member held on the dielectric layer is fed by the rotation of the drive roller.

The electric charger may be a charge roller having a conductivity at least on its surface and rotated in contact with the drive roller, or a conductive brush in contact with the drive roller, or an electric charger utilizing corona discharge arranged in the proximity of the drive roller.

Moreover, the separator may be a rotatable separation roller or a separation claw.

When such a sleeve rotation-feed apparatus is used in a developing apparatus, an image formation apparatus, and a fixation apparatus, the following configuration is employed.

(1) When applied to a developing apparatus, the sleeve may be a seamless stainless or other metal belt whose outer surface has been subjected to sand blast, or a belt having conductivity at least on the outer surface, or a belt having a dielectric layer such as rubber on its surface. By using these sleeves, it is possible to form a uniform toner thin film layer on the sleeve.

(2) When applied to a developing apparatus or an image formation apparatus, the sleeve may be a metal belt so that the sleeve inner surface is used as an electrode, so as to apply a potential difference such as a developing bias in the ordinary electrophotographic process. When a dielectric belt is used for the sleeve, a conductive surface of the dielectric belt is partially exposed to serve as an electrode for applying voltage.

(3) When applied to a fixation apparatus, there is provided a drive roller having heating means for heating the roller surface and a cooling roller. The sleeve is preferably made from a material having a high parting capability, so as to prevent toner offset.

Figure 1:
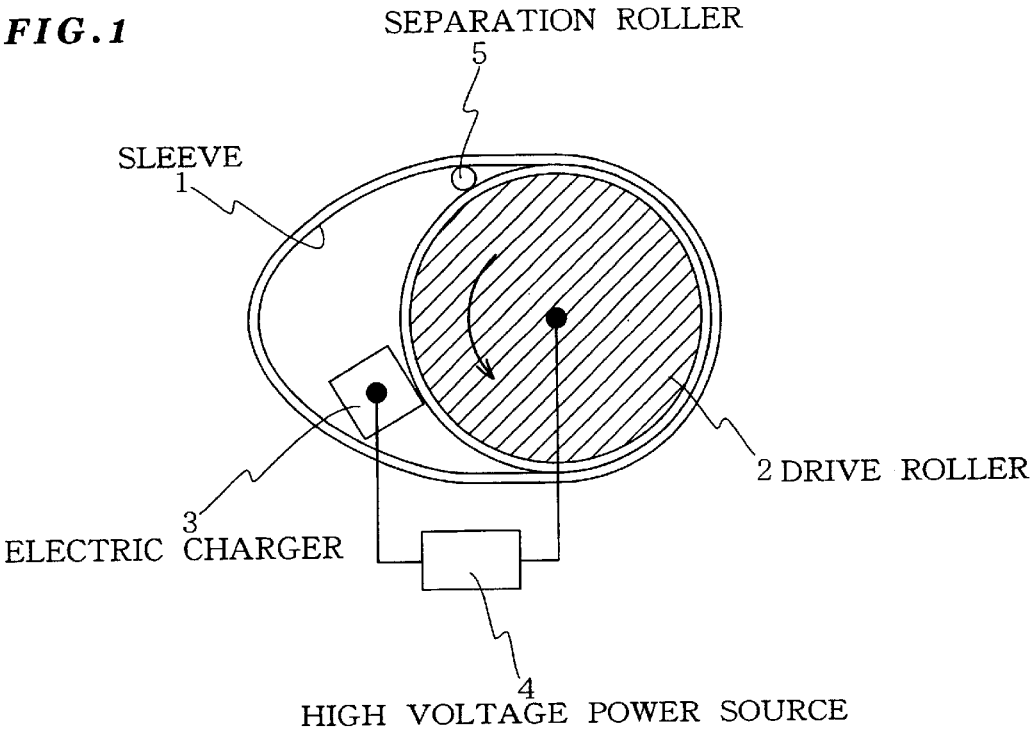
FIG. 1 is a cross sectional view of basic configuration of a sleeve rotation-feed apparatus according to the present invention.

FIG. 1 is a cross sectional view of an essential portion of the sleeve rotation-feed apparatus according to the embodiment of the present invention.

Referring to FIG. 1, explanation will be given on the outline of this embodiment. The sleeve rotation-feed apparatus according to the present embodiment includes: a rotatable drive roller 2 in which at least surface is made from a dielectric material; an electric charger 3 for charging the surface of the drive roller 2; separator (separation roller 5 in the example of FIG. 1) arranged in the proximity of the drive roller 2; a high voltage power source 4 for applying a potential difference to the drive roller 2 and the electric charger 3; and a sleeve 1 surrounding the drive roller 2, the electric charger 3, and the separator 5.The drive roller 2 is rotated and the high voltage power source 4 applies to the electric charger 3 a high voltage whose positive and negative polarities are periodically exchanged on the base of the potential of the conductive portion of the drive roller 2, so that the surface of the drive roller 2 is periodically changed between plus and minus.

When the drive roller 2 is charged, the sleeve 1 is adsorbed to and held by the drive roller 2 and rotated together with the drive roller 2 so as to be fed. The sleeve 1 is then peeled off from the drive roller 2 by the separator 5 and a sag is obtained. The drive roller 2 further rotates, and the sag of the sleeve 1 is again adsorbed to and held by the drive roller 2 which is periodically charged by plus and minus and rotated together with the drive roller 2.

Hereinafter, the present embodiment of the invention will be detailed through examples with reference to the attached drawings.

EXAMPLE 1

Figure 2:
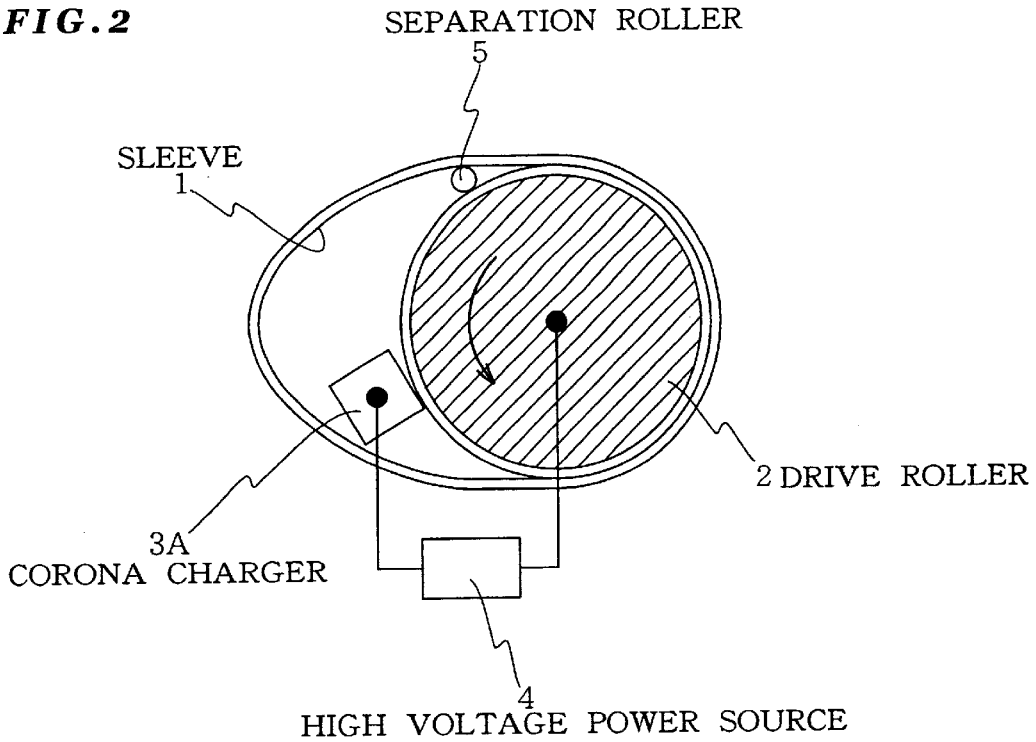
FIG. 2 is a cross sectional view of a sleeve rotation-feed apparatus according to a first example of the present invention.

FIG. 2 is a cross sectional view schematically showing a sleeve rotation-feed apparatus according to a first example of the present invention.

This sleeve rotation-feed apparatus of this first example includes a rotatable drive roller 2 in which at least a surface is a dielectric; a corona charger 3A for charging the surface of this drive roller 2; a high voltage power source 4 for applying a potential difference between the drive roller 2 and the corona charger 3A; a sleeve I surrounding the drive roller 2 and the corona charger 3A; and a separation roller 5.

The drive roller 2 is made from a metal roller or a roller having on its surface a conductive layer which is covered with an insulating resin layer. The conductive layer to be formed on the roller surface may be a metal thin film, a metal deposited film, a transparent ITO (indium-tin oxide) film or the like.

The insulating resin may be polycarbonate, epoxy resin, PET (polyethylene terephthalate) or the like. The insulating resin preferably has a thickness in a range from 0.001 mm to 1 mm and more preferably, in a rang e from 0.01 mm to 0.1 mm, which helps to obtain a preferable charge d state of the drive roller 2. The drive roller 2 is rotated and the high voltage power source 4 applies to the corona charger 3A a high voltage whose polarity is periodically changed between plus and minus based on the potential of the conductive portion of the drive roller 2, so that the surface of the drive roller 2 is charged by plus and minus periodically. It should be noted that the corona charger 3A may be a charger using corona discharge such as Scorotron.

When the drive roller 2 is charged, the sleeve 1 is adsorbed to the drive roller 2 so as to be rotated together with the drive roller 2 and then separated from the drive roller 2 by the separation roller 5, thus obtaining a sag portion.

The sleeve 1 may be made from a dielectric film such as PET or a metal belt. The metal belt whose internal surface is coated with a dielectric maintains the charge on the surface of the drive roller 2 when the metal belt is brought into contact with the charged drive roller 2. This enables to obtain a stronger adsorption and a stable sleeve rotation.

It is preferable that the internal surface of the metal belt be coated by a dielectric in such a manner that a portion of the metal belt is exposed, so that electro-conductivity is obtained between the metal belt, through the exposed portion, and the bias power source, i.e., the metal belt can be used as an electrode.

It is further preferable that the exposed portion be a belt-shaped stripe running through the inner circumference of the metal belt, so that a conductive brush fixed so as to be in contact with this exposed portion serves for conductivity between the metal belt and a power source such as a bias power source.

EXAMPLE 2

Figure 3:
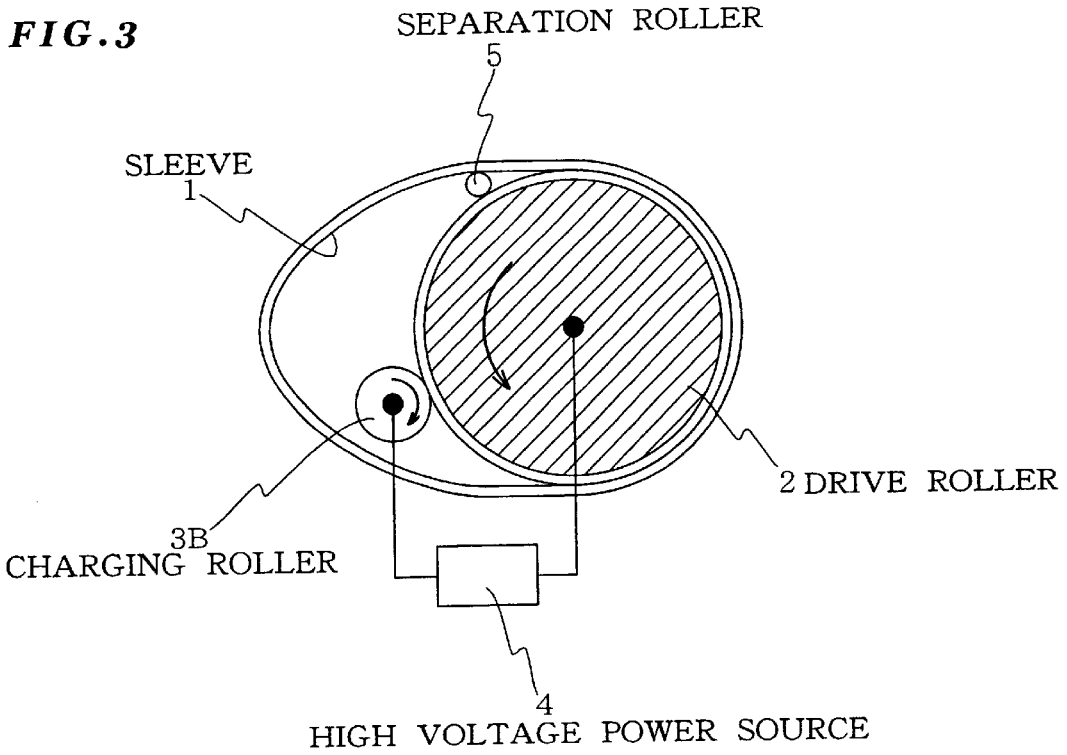
FIG. 3 is a cross sectional view of a sleeve rotation-feed apparatus according to a second example of the present invention.

FIG. 3 is a cross sectional view schematically showing a sleeve rotation-feed apparatus according to a second example of the present invention.

In this example, the electric charger 3 is a charging roller 3B. The charging roller 3B is electro-conductive at least on its surface and may be a metal roller, conductive rubber roller, or a conductive brush roller.

By using the conductive rubber roller or the conductive brush roller, it is possible to obtain a uniform contact with the surface of the drive roller, which in turn enables to obtain uniform charge as well as a strong adsorption between the drive roller 2 and the sleeve 1.

The other configurations are identical to Example 1 and their explanations are omitted.

EXAMPLE 3

Figure 4:
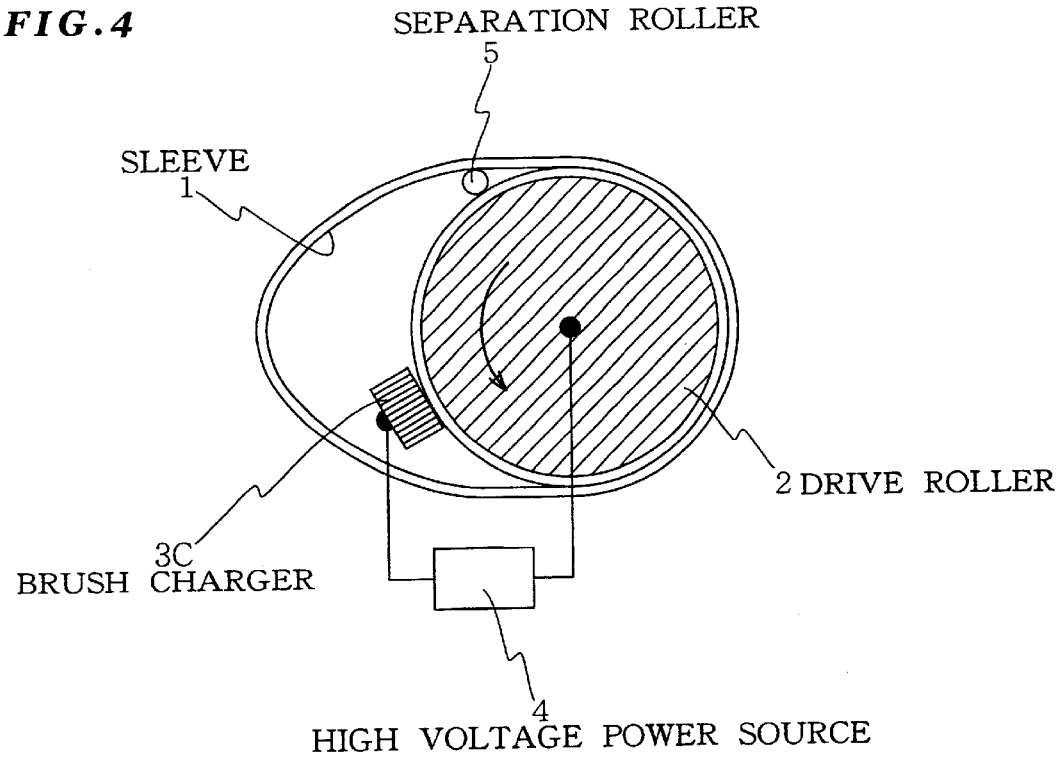
FIG. 4 is a cross sectional view of a sleeve rotation-feed apparatus according to a third example of the present invention.

FIG. 4 is a cross sectional view schematically showing a sleeve rotation-feed apparatus according to a third example of the present invention.

In this example, the electric charger 3 is a brush charger 3C. By using the brush charger 3C, it is possible to obtain a uniform contact with the surface of the drive roller 2 and uniform charge as well as a greater adsorption force between the drive roller 2 and the sleeve 1.

The other configurations are identical with Example 1 and their explanations are omitted.

It should be noted that in the aforementioned first to third examples, the separation roller 5 is used for separating the sleeve I from the drive roller 2. However, it is also possible to use such a separation claw as separator.

Moreover, explanation has been given on a case that the drive roller 2 surface is charged by plus and minus alternately. However, it is also possible to constitute a sleeve rotation-feed apparatus by uniformly charging the entire surface of the drive roller 2 with one of the polarities, or alternately forming a non-charged portion and a charged portion of plus or minus.

When the surface of the drive roller 2 is alternately charged by plus and minus, at a place apart from the drive roller 2, the potential caused by the charge is relatively small because plus and minus cancels each other. On the other hand, when only one of the polarities is used, the potential becomes greater and dusts and toner easily adhere to the surface of the drive roller 2, requiring cleaning of the drive roller 2 surface.

Moreover, it is preferable to provide a charge remover at the upstream of the electric charger 3 so as to cancel a charge history, which helps to obtain a stable rotation-feed of the sleeve 1. The charge remover may be conventional means.

EXAMPLE 4

Figure 5:
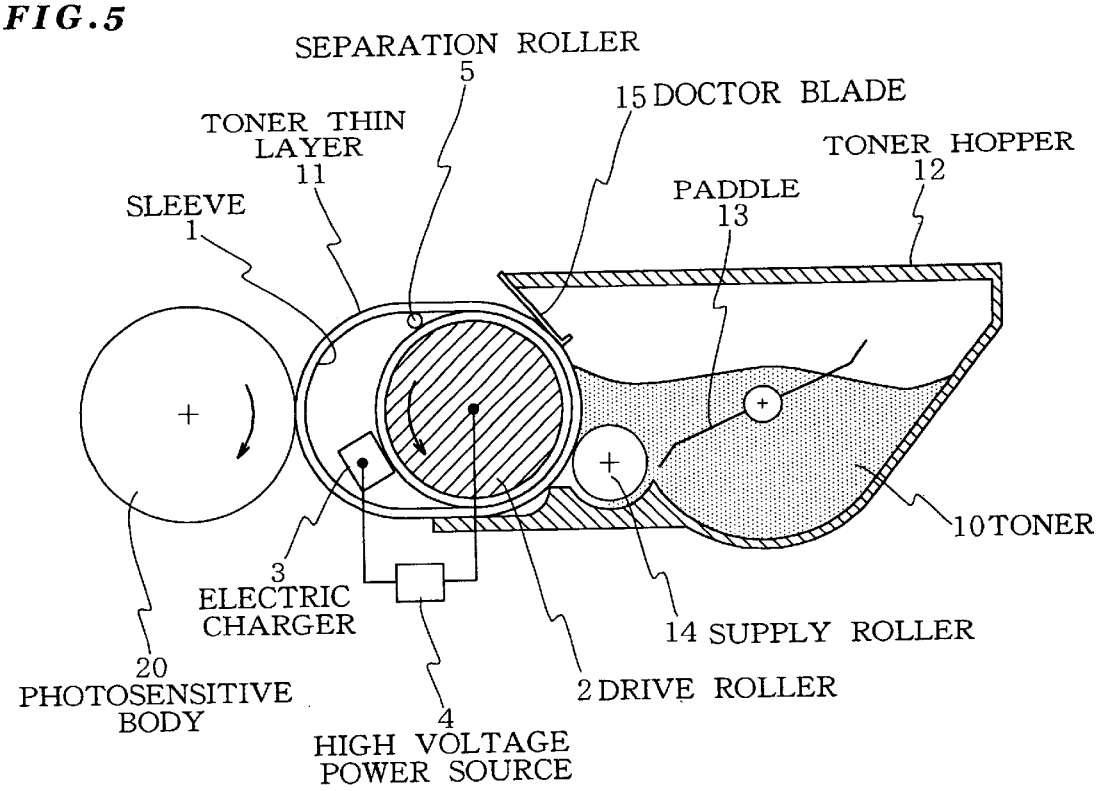
FIG. 5 is a cross sectional view of a developing apparatus according to a fourth example of the present invention.

FIG. 5 is a cross sectional view of a developing apparatus according to a fourth example of the present invention.

The developing apparatus includes: the sleeve rotation-feed apparatus according to the present invention; a supply roller 14 arranged in proximity of the sleeve rotation-feed apparatus via the sleeve 1; a doctor blade 15 for regulating a toner amount; a puddle 13 for supplying toner; and a toner hopper 12 containing toner 10. The toner 10 is supplied to the supply roller 14 by the puddle 13. The supply roller 14 supplies toner 10 to the surface of the sleeve 1, so that the toner 10 charged adheres to the sleeve 1. The toner 10 adhering to the sleeve 1 is regulated in a predetermined thickness by the doctor blade 15, so that a uniform toner thin layer 11 is formed on the sleeve 1.

The surface of the photosensitive body 20 has an electrostatic latent image formed by charge by conventional means, and the latent image is developed by the toner at the position where the photosensitive body 20 is in proximity with the sleeve 1.

According to this developing method, the photosensitive body 20 is in such a soft contact with the sleeve 1 that the photosensitive body 20 is not easily shaved. This increases the service life of the photosensitive body 20. Especially when the photosensitive body is rotated at a high speed, e.g., in an electrophotographic apparatus printing twenty A4 size sheets per minute, this exhibits a great effect to increase the service life of the photosensitive body.

Moreover, since the sleeve 1 is in contact with the photosensitive body 20 with a small contact pressure, there is no lowering of resolution due to pressing of the toner image, and the image is not pushed down. This enables to obtain a high quality.

Furthermore, conventionally, dusts and flying toner are sandwiched between the sleeve 1 and the drive roller 2, which lowers a friction force, disturbing stable rotation of the sleeve 1, resulting in a defective image. However, in the present invention, the sleeve 1 is in contact with the drive roller 2 by electrostatic force, the sleeve 1 does not sleeve over the surface of the drive roller 2, enabling to-obtain a stable image formation.

Moreover, it is preferable to provide cleaning means before the electric charger 3, for removing dusts from the surface of the drive roller 2. This ensures contact between the sleeve 1 and the drive roller 2, enabling to obtain stable image formation.

The supply roller 14 is preferably a foamed roller which realizes a stable toner supply.

The doctor blade 15 may be made from stainless steel or a doctor blade conventionally used.

The sleeve 1 may be a seamless metal belt such as stainless steel or a dielectric film such as PET whose surface is made electro-conductive.

The belt is preferably has been subjected sand blasting or chemical etching to make the surface rough, which enables to obtain a uniform thin layer of toner.

The cleaning means may be a conventional brush cleaner or blade.

EXAMPLE 5

Figure 6:
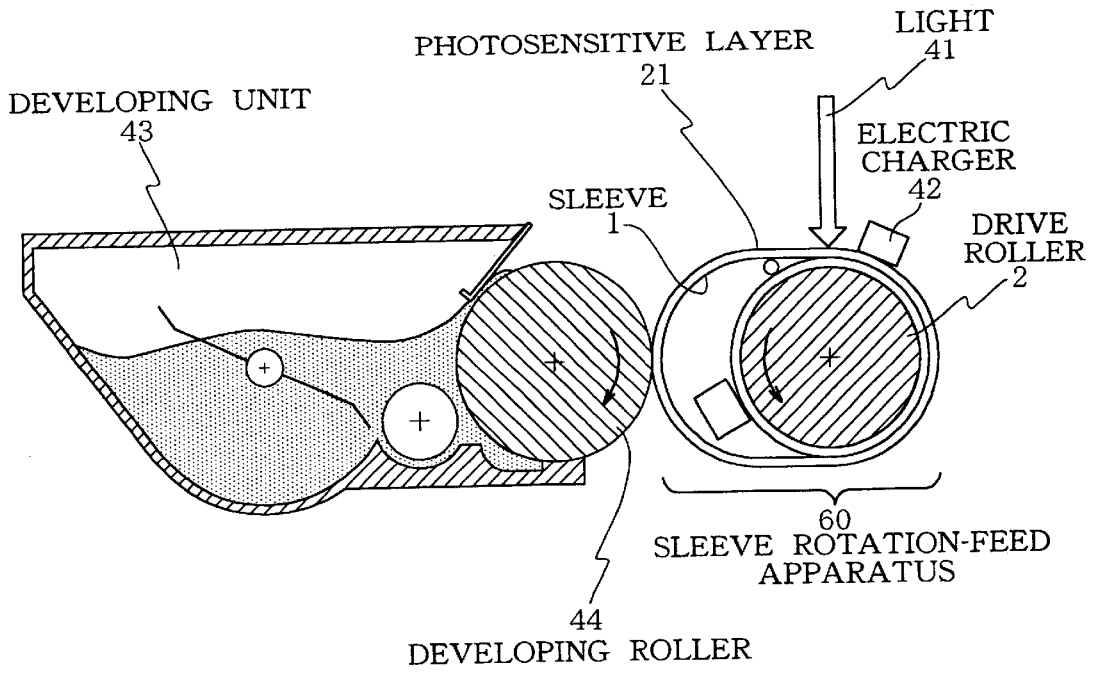
FIG. 6 is a cross sectional view of an image formation apparatus according to a fifth example of the present invention.

FIG. 6 is a cross sectional view of an image formation apparatus according to a fifth example of the present invention.

The image formation apparatus includes: a sleeve rotation-feed apparatus 60 having a sleeve 1 whose outer circumference is covered with a photosensitive layer 21; a developing unit 43, and an electric charger 42 for charging the photosensitive layer 21.

Firstly, the photosensitive layer 21 is uniformly charged by the electric charger 42 and an electrostatic latent image is formed on the photosensitive layer 21 by light 41 from a light source (not depicted). This electrostatic latent image is made visible by a developer from the developing unit 43 at the non-contact portion of the sleeve 1 and the drive roller 2.

Since the contact force between the photosensitive layer 21 formed on the sleeve 1 and the developing roller 44, the photosensitive layer 21 is little shaved, enabling to obtain stable image formation for a long period of time. The image formed on the sleeve 1 is transferred and fixed onto a recording medium such as paper.

A transfer roller (not depicted) arranged to sandwich a recording medium together with the sleeve 1 forms an electric field to adsorb a developer to the transfer roller and the toner image which has been made visible is transferred onto the recording medium. The photosensitive layer 21 may be made from a conventional inorganic photosensitive body or an organic photosensitive body.

The image formation apparatus using the sleeve rotation-feed apparatus 60 according to this example can provide a stable rotation-feed of the sleeve 1, enabling to obtain a high quality printing. The contact pressure of the photosensitive layer 21 against the developing roller 44 is significantly reduced compared to the conventional method. This suppresses shaving of the photosensitive layer 21 and increases the service life of the apparatus.

Moreover, it is possible to obtain a greater contact width of the photosensitive layer 21, i.e., a so-called nip width, which improves developing efficiency of the developer. Since the contact pressure is small, the image is not pushed down.

EXAMPLE 6

Figure 7:
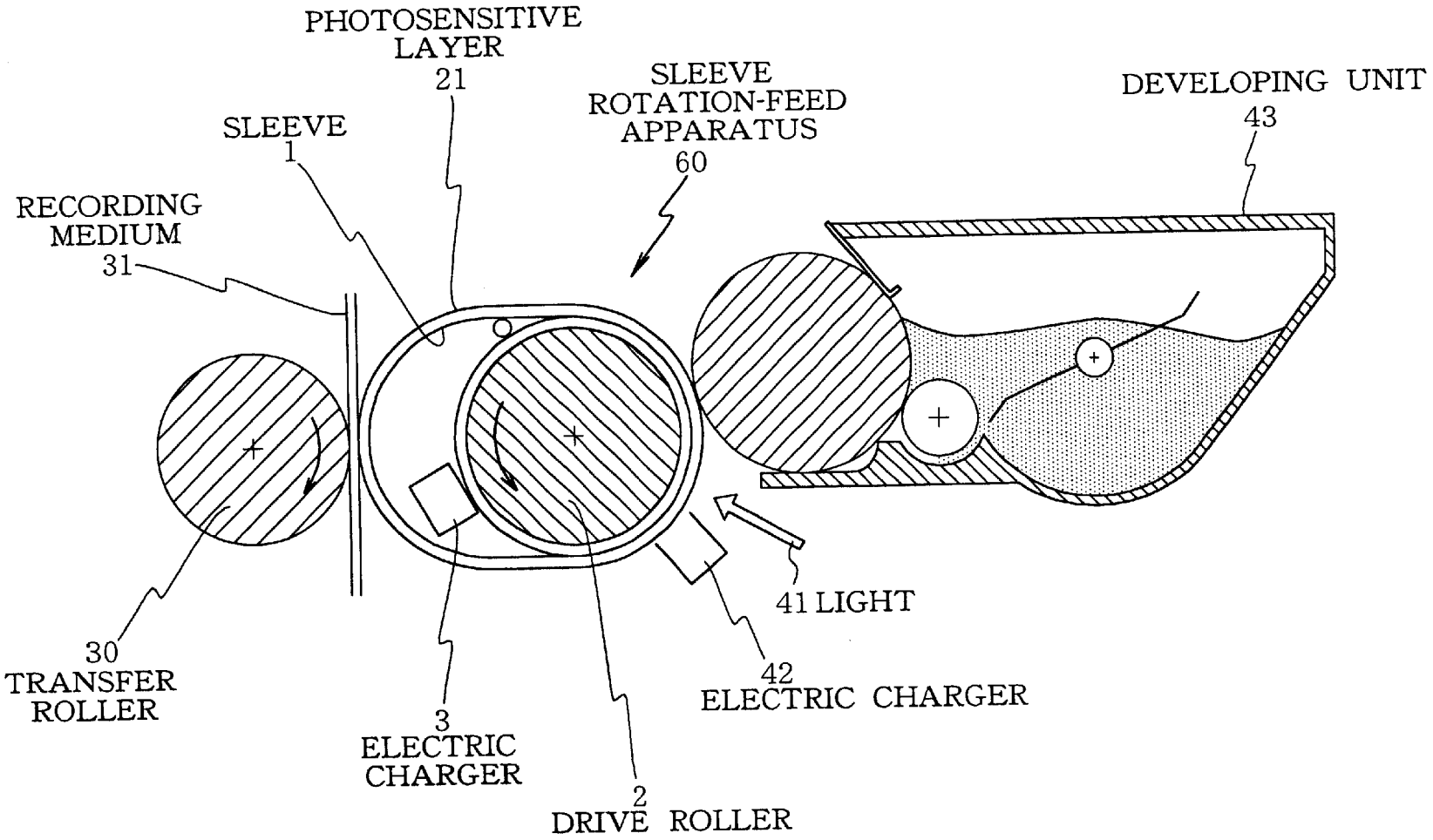
FIG. 7 is a cross sectional view of an image formation apparatus according to a sixth example of the present invention.

FIG. 7 is a cross sectional view of an image formation apparatus according to a sixth example of the present invention.

This image formation apparatus includes: the sleeve rotation-feed apparatus 60 having a sleeve whose outer circumference is covered with a photosensitive layer 21; a developing unit 43, an electric charger 42 for charging the photosensitive layer 21; and a transfer roller 30.

Firstly, the photosensitive layer 21 is uniformly charged by the electric charger 42 and an electrostatic latent image is formed on the photosensitive layer 21 by light 41 from a light source (not depicted) This electrostatic latent image is made visible by the developing unit 43 using a developer. The transfer roller 30 arranged to sandwich a recording medium 31 together with the sleeve 1 forms an electric field to adsorb a developer to the transfer roller 30 and the toner image which has been made visible is transferred onto the recording medium 31. The photosensitive layer 21 may be made from a conventional inorganic photosensitive body or an organic photosensitive body.

The image formation apparatus using the sleeve rotation-feed apparatus 60 according to this example can provide a stable rotation-feed of the sleeve 1, enabling to obtain a high quality printing. The contact pressure of the photosensitive layer 21 against the recording medium 31 is significantly reduced compared to the conventional method. This suppresses shaving of the photosensitive layer 21 due to contact with the recording medium 31 and increases the service life of the apparatus. Moreover, it is possible to obtain a greater contact width of the photosensitive layer 21, i.e., a so-called nip width, which improves developing efficiency of the developer.

Since the contact pressure is small, there is no lowering of resolution due to pressing of the toner image, and the image is not pushed down. This enables to obtain a high quality image.

EXAMPLE 7

Figure 8:
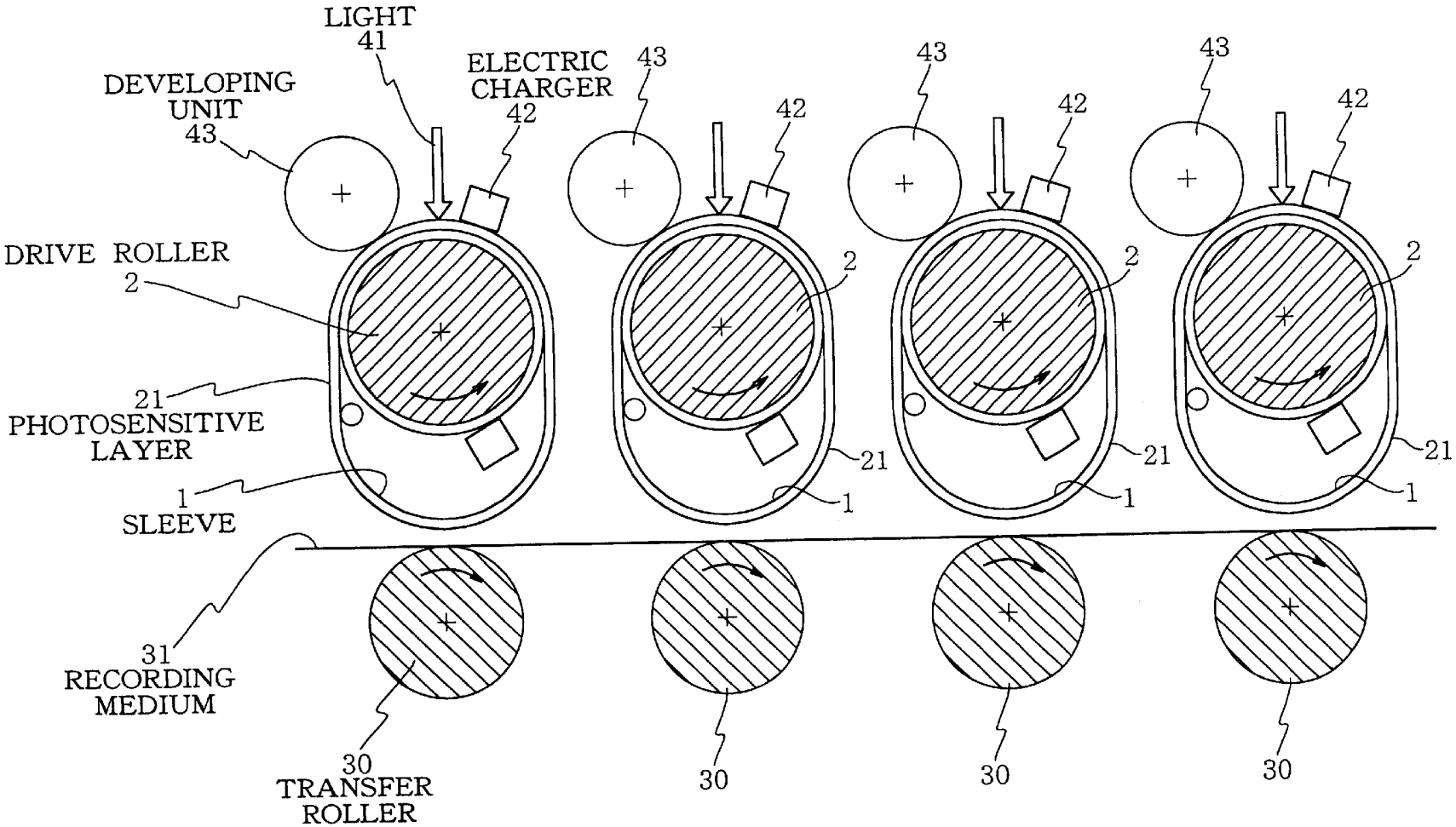
FIG. 8 is a cross sectional view of an image formation apparatus according to a seventh example of the present invention.

FIG. 8 is a cross sectional view of an image formation system using a plurality of image formation apparatuses using the sleeve rotation-feed apparatus according to a seventh example of the present invention.

This image formation system includes four image formation apparatuses using as the developers, Black, Cyan, Magenta, and Yellow. The developers are successively transferred onto the recording medium 31.

In the image formation apparatus according to the present example, the photosensitive layer 21 having a toner image is in soft contact with the recording medium 31 and the sleeve rotation is very stable, For example, when the Magenta developer is transferred, there is no disturbance of the Black and Cyan images which have been transferred beforehand. Thus, it is possible to obtain a high quality image formed by developers of multiple colors. It should be noted that in this example, four colors are used, but the present invention is not to be limited to these colors.

EXAMPLE 8

Figure 9:
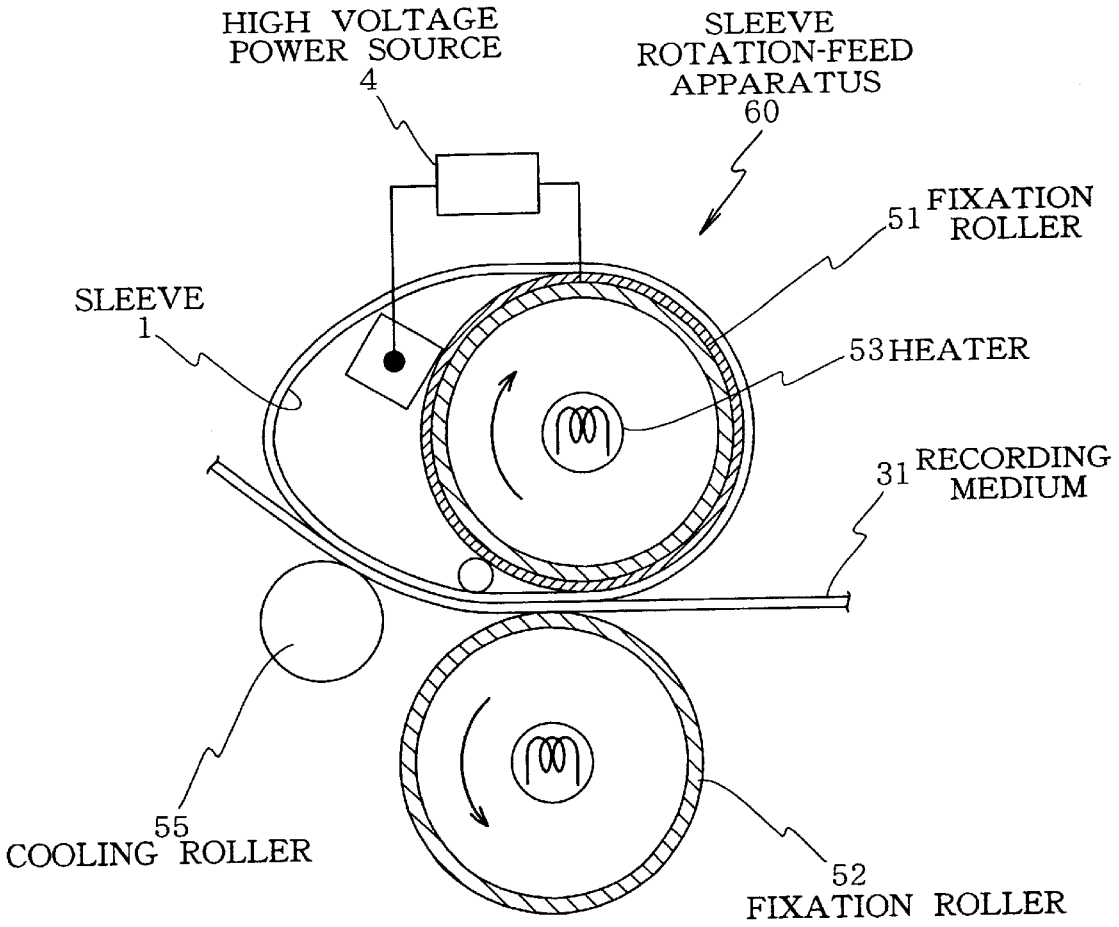
FIG. 9 is a cross sectional view of a fixation apparatus according to an eighth example of the present invention.

FIG. 9 is a cross sectional view of a fixation apparatus using the sleeve rotation-feed apparatus 60 according to an eighth example of the present invention.

This fixation apparatus includes: the sleeve rotation-feed apparatus 60 including a fixation roller 51 having a heater 53 inside; a fixation roller 52; and a cooling roller 55. The sleeve 1 is may be a metal belt such as stainless steel or a dielectric belt. It is preferable to use a belt coated with a material having a small surface energy such as a fluorine compound and silicon rubber, so as to prevent adhesion of a developing material onto the surface.

The recording medium 31 on which a powdered image (toner image) has been formed by the aforementioned image formation method or a conventional image formation method is fed to the fixation apparatus. The fixation roller 51 is set to a temperature equal to or above the melting temperature of the developer so that the developer on the recording medium 31 sandwiched by the fixation roller 51 and the fixation roller 52 is melted.

After this, the recording medium 31 in contact with the sleeve 1 is fed to a point sandwiched between the cooling roller 55 and the sleeve 1. At the point sandwiched by the cooling roller 55 and the sleeve 1 is at a temperature below the melting temperature of the developer and the developer is solidified. The solidified developer adheres to the recording medium 31 having a stronger adhesion force than the sleeve 1. Thus, an image is fixed to the recording medium 31.

When forming a color image, the developer should be melted and the layer of the developer should be made transparent. However, when the developer is melted, the molten developer adheres to the fixation roller. For this, the surface of the fixation roller is conventionally coated with silicon oil, so as to facilitate to release the molten developer. However, this method using silicon oil causes a problem that oil adheres to an image of the recording medium and a problem that an oil application mechanism increases the size of the apparatus.

On the contrary, the fixation apparatus of the present example can realize an oil-less fixation apparatus.

Moreover, by regulating the sleeve surface shape into a rough surface, it is possible to obtain a mat-type image after fixation, or by using a flat surface sleeve, it is possible to obtain a gross-type image.

It should be noted that for heating the fixation roller 51, instead of using the aforementioned heater 53, it is also possible to employ a so-called plane-shape heater, i.e., to bury a heater line in the surface layer or the intermediate layer of the fixation roller 51.

EXAMPLE 9

Figure 10:
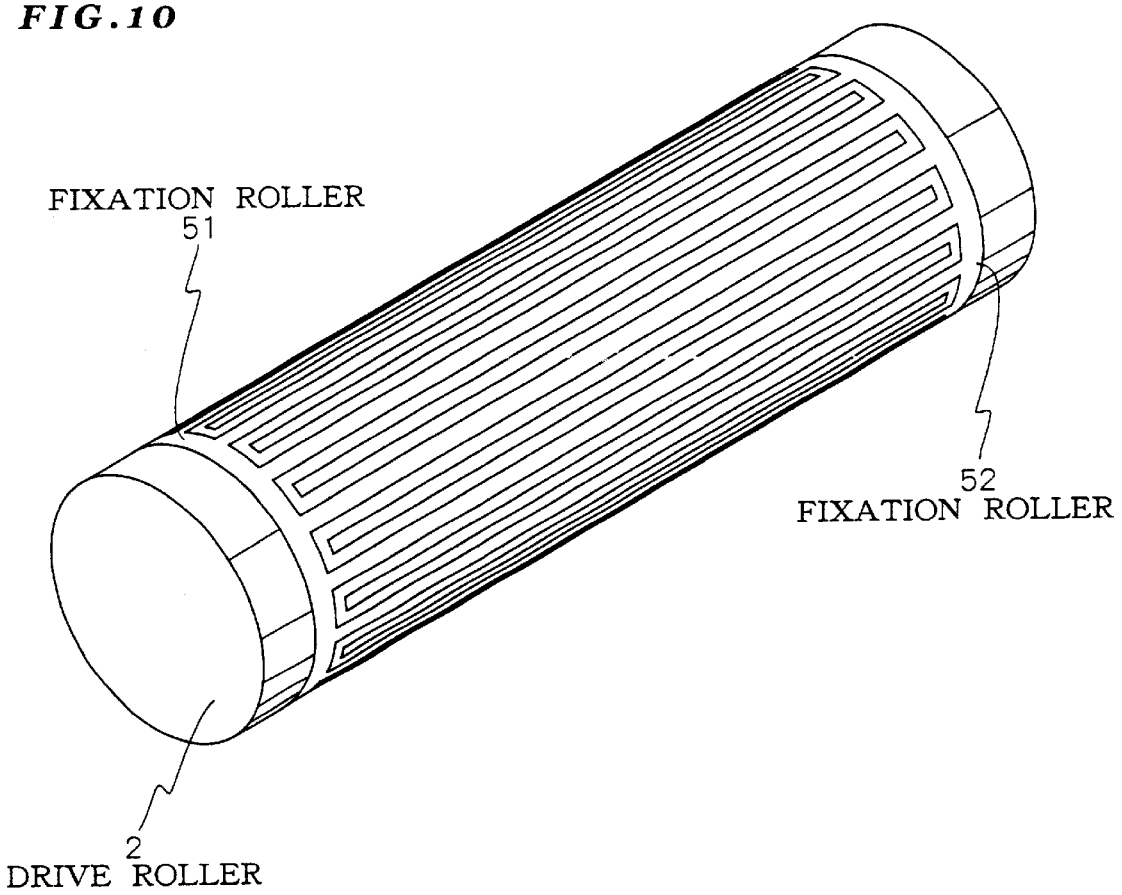
FIG. 10 is a perspective view of a drive roller of a sleeve rotation-feed apparatus according to a ninth example of the present invention.
Figure 11:
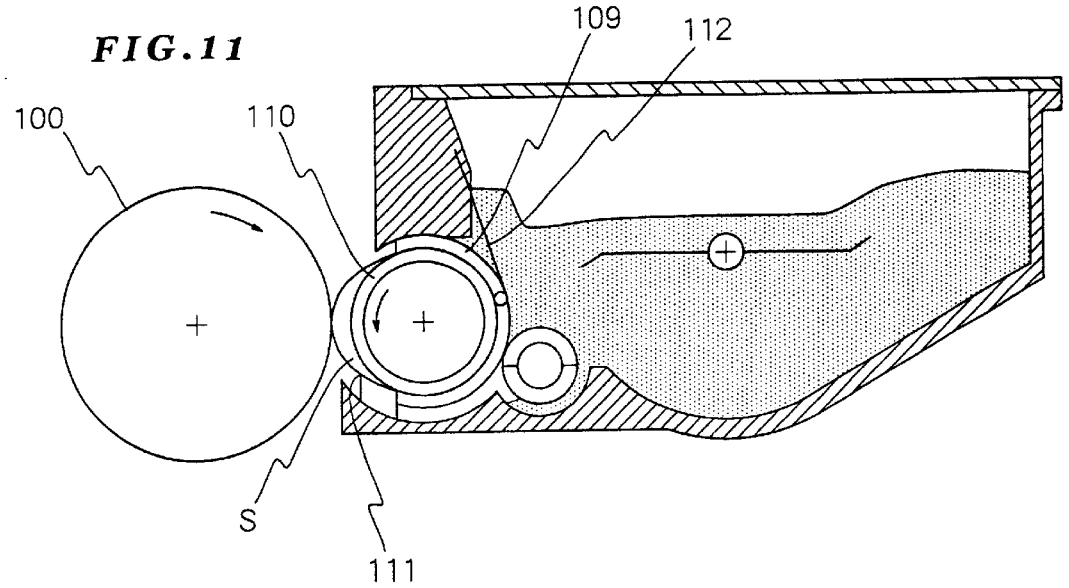
FIG. 11 is a cross sectional view of a configuration example of a conventional electrostatic latent image developing apparatus.

FIG. 10 is a perspective view of a drive roller 2 of a sleeve rotation-feed apparatus as a nine example of the present invention.

In the aforementioned examples, the surface of the drive roller 2 is charged plus and minus alternately by an electric charger, and the sleeve is pulled to the drive roller while fed. In this ninth example, as shown in FIG. 10, the drive roller 2 is covered by linear plus electrodes 51 and linear minus electrodes 52 which are alternately arranged at an identical interval in the circumferential direction.

That is, the plus electrodes 51 constitute a plus electrode block and the minus electrodes 52 constitute a minus electrode block. A plus voltage is applied to the plus electrode block and a minus voltage is applied to the minus electrode block, so that the same effect as the drive roller in the aforementioned examples can be obtained.

The electrodes are formed by a conductive material such as an aluminiuim deposition film and a metal tape. Moreover, after formation of the electrodes, it is preferable to provide a protection film on the roller surface for protecting the electrodes and preventing destruction of the electrodes.

In the aforementioned embodiment of the present invention, it is possible to rotate the sleeve at a stable speed with a small drive force unlike the conventional apparatus in which a rigid or flexible sleeve is rotated by a friction force generated when the sleeve is pushed by a guide member or the like against a drive roller.

Moreover, the sleeve can be fed with a non-contact state of the outer surface of the sleeve and accordingly, no scratch is generated, for example, on a photosensitive layer formed on the outer surface of the sleeve. This enables to obtain a stable image formation for a long period of time.

Furthermore, it is possible to feed a sleeve having a sag together with rotation of a roller.

Moreover, according to the present embodiment, the photosensitive body is brought into soft contact with the developer and the recording medium. This increases the service life of the photosensitive body, the developer and the developing roller, and assures its stable operation, enabling to obtain a preferable image without a toner image crush or contamination with dust.

Furthermore, according to the present embodiment, the photosensitive body is in soft contact with the developer and the sleeve rotation is stable.

Accordingly, in a case of a multi-color image formation apparatus in which a plurality of developers are superimposed, a plurality of developers can be transferred without disturbing an image formed beforehand by a developer. Thus, it is possible to obtain a high-quality multi-color image formation apparatus.

Moreover, in the fixation apparatus according to the present embodiment, the toner on the recording medium is heated and melted and the recording medium is separated from the sleeve at the position where the toner is solidified. Accordingly, it is possible to sufficiently melt the toner and prevent the toner offset to the sleeve. Thus, it is possible to realize an oil-less fixation apparatus.

As has been described above, in the sleeve rotation-feed apparatus according to the present invention, an electrostatic force obtained from charging of a dielectric layer of the drive roller is used to absorb a portion of a thin film sleeve to a portion of the roller surface so as to be fed, and then the thin film sleeve is separated from the drive roller by separator provided at a necessary position, so that various processes can be performed by the thin film sleeve.

Accordingly, the thin film sleeve can be fed without using a friction force of the drive roller and a guide member as in the conventional apparatus. This enables to eliminate scratches on the thin film sleeve caused by friction and to select the drive roller material without considering the friction coefficient. Thus, it is possible to provide a durable thin film sleeve and flexibility in designing the apparatus.

Moreover, in the sleeve rotation-feed apparatus according to the present invention, an electrostatic absorption force obtained by applying current to the electrode blocks of the drive roller absorbs a portion of the thin film sleeve to a portion of the roller surface so as to be fed and then the thin film sleeve is separated from the drive roller by separator provided at a necessary position, so that various processes can be performed by the thin film sleeve.

Accordingly, the thin film sleeve can be fed without using a friction force of the drive roller and the guide member. This enables to eliminate scratches on the thin film sleeve caused by the friction and to select the driver roller material without considering the friction coefficient. It is possible to provide a durable thin film sleeve and flexibility of designing the apparatus.

Moreover, in the developing apparatus according to the present invention, an electrostatic absorption force obtained from charging of the dielectric layer of the drive roller is used to absorb a portion of the thin film sleeve to a portion of the roller surface so as to be fed, and then the thin film sleeve is separated from the drive roller by separator provided at a necessary position, so that development and other processes are performed by the thin film sleeve.

Moreover, in the development apparatus according to the present invention, an electrostatic absorption force obtained by applying current to the electrode blocks of the drive roller is used to absorb a portion of the thin film sleeve to a portion of the roller surface so as to be fed and then the thin film sleeve is separated from the drive roller by separator provided at a necessary position, so that processes such as development can be performed by the thin film sleeve.

Accordingly, the thin film sleeve can be fed without using a friction force of the drive roller and the guide member. This enables to eliminate scratches on the thin film sleeve caused by the friction and to select the driver roller material without considering the friction coefficient. It is possible to provide a durable thin film sleeve and flexibility of designing the apparatus.

Furthermore, since the photosensitive body is in soft contact with the developer, it is possible to rotate the sleeve at a faster speed than in the conventional apparatus, increase the service life of the photosensitive body, developer, and the developing roller, and obtain stable operation thereof for a long period of time, which in turn enables to obtain a preferable image without crush of a toner image and contamination with dusts.

Moreover, in the image formation apparatus according to the present invention, an electrostatic absorption force obtained from charging of the dielectric layer of the drive roller is used to absorb a portion of the thin film sleeve to a portion of the roller surface so as to be fed, and the thin film sleeve is separated from the drive roller by separator provided at a necessary position, so that an image formation and other processes are performed to the thin film sleeve having a photosensitive layer on its surface.

Moreover, in the image formation apparatus according to the present invention, an electrostatic absorption force obtained by applying current to the electrode blocks of the drive roller is used to absorb a portion of the thin film sleeve to a portion of the roller surface so as to be fed and then the thin film sleeve is separated from the drive roller by separator provided at a necessary position, so that image formation and other processes can be performed on the thin film sleeve having a photosensitive layer on its surface.

Accordingly, the thin film sleeve can be fed without using a friction force of the drive roller and the guide member. This enables to eliminate scratches on the thin film sleeve caused by the friction and to select the driver roller material without considering the friction coefficient. It is possible to provide a durable thin film sleeve and flexibility of designing the apparatus.

Furthermore, the photosensitive body is in soft contact with a recording medium. This increases the service life of the photosensitive body and assures a stable operation for a long period of time, enabling to obtain a preferable image without toner image crush or contamination with dust.

Moreover, in the fixation apparatus according to the present invention, an electrostatic absorption force obtained by charging of the dielectric layer of the drive roller is used to absorb a portion of the thin film sleeve to a portion of the roller surface so as to be fed, and then the thin film sleeve is separated from the drive roller by separator provided at a necessary position, so that fixation and the like are performed to the thin film sleeve.

Moreover, in the fixation apparatus according to the present invention, an electrostatic absorption force obtained by applying current to the electrode blocks the drive roller is used to absorb a portion of the thin film sleeve to a portion of the roller surface so as to be fed, and then the thin film sleeve is separated from the drive roller by separator provided at a necessary position, so that fixation and the like are performed to the thin film sleeve.

Accordingly, the thin film sleeve can be fed without using a friction force of the drive roller and the guide member. This enables to eliminate scratches on the thin film sleeve caused by the friction and to select the driver roller material without considering the friction coefficient. It is possible to provide a durable thin film sleeve and flexibility of designing the apparatus.

Furthermore, the toner image on the recording medium is heated so as to be melted and the sleeve is separated from the recording medium at a position where the molten toner is solidified. Thus, it is possible to sufficiently melt the toner and prevent toner offset to the sleeve. Thus, it is possible to provide an oil-less fixation apparatus.

The invention may be embodied in other specific forms without departing from the spirit or essential characteristic thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 11-134142 (Filed on May 14$^{th}$, 1999) including specification, claims, drawings and summary are incorporated herein by reference in its entirety.

What is claimed is:

1. A sleeve rotation-feed apparatus comprising:

a drive roller in which at least a portion of the roller surface is a dielectric layer;

an electric charger for charging the roller surface of the drive roller;

a power source for applying a potential difference between the roller surface of the drive roller and the electric charger;

a separator arranged in the proximity of the drive roller; and a sleeve arranged so as to surround the drive roller, the electric charger, and the separator in such a manner that a portion of the sleeve is in contact with the drive roller, wherein the separator separates the sleeve from the drive roller, wherein the dielectric layer of the drive roller is used to absorb a portion of the sleeve to a portion of the roller surface, so as to be fed.

2. A sleeve rotation-feed apparatus as claimed in claim 1, wherein the separator is a rotatable separation roller.

3. A sleeve rotation-feed apparatus as claimed in claim 1, wherein the separator is a separation claw.

4. A sleeve rotation-feed apparatus as claimed in claim 1, wherein the sleeve has a flexibility.

5. A sleeve rotation-feed apparatus as claimed in claim 1, wherein the sleeve is a rigid body.

6. A sleeve rotation-feed apparatus as claimed in claim 1, wherein said apparatus further comprises a cleaner for cleaning the roller surface of the drive roller.

7. A sleeve rotation-feed apparatus as claimed in claim 1, wherein the roller surface of the drive roller is charged plus and minus alternately.

8. A sleeve rotation-feed apparatus as claimed in claim 1, wherein the roller surface of the drive roller includes a non-charged region and a charged region of plus or minus alternatively.

9. A sleeve rotation-feed apparatus as claimed in claim 1, wherein the sleeve has an insulation layer on its inner surface.

10. A sleeve rotation-feed apparatus comprising:

a drive roller having a roller surface formed by a material of a high resistance and a plurality of linear electrodes extending in axial direction of the roller and arranged in a circumferential direction, wherein every other electrode constitutes an electrode block electrically connected, thus obtaining two electrode blocks;

a power source for applying a potential difference between the two electrode blocks;

a separator arranged in the proximity of the drive roller; and a sleeve arranged so as to surround the drive roller and the separator in such a manner that a portion of the sleeve is in contact with the drive roller, wherein the separator separates the sleeve from the drive roller, wherein the electrode blocks of the drive roller are used to absorb a portion of the sleeve to a portion of the roller surface, so as to be fed.

11. A sleeve rotation-feed apparatus as claimed in claim 9, wherein the roller surface is entirely covered by a high-resistance material layer.

12. A sleeve rotation-feed apparatus as claimed in claim 9, wherein the sleeve has an insulation layer on its inner surface.

13. A developing apparatus comprising:

a sleeve rotation-feed apparatus including:

a drive roller in which at least a portion of the roller surface is a dielectric layer;

an electric charger for charging the roller surface of the drive roller;

a power source for applying a potential difference between the roller surface of the drive roller and the electric charger;

a separator arranged in the proximity of the drive roller; and a sleeve arranged so as to surround the drive roller, the electric charger, and the separator in such a manner that a portion of the sleeve is in contact with the drive roller, wherein the separator separates the sleeve from the drive roller, wherein the dielectric layer of the drive roller is used to absorb a portion of the sleeve to a portion of the roller surface, so as to be fed;

a toner supplier for supplying toner to a surface of the sleeve; and a doctor blade for regulating a toner layer.

14. A developing apparatus as claimed in claim 13, wherein the separator is a rotatable separation roller.

15. A developing apparatus as claimed in claim 13, wherein the separator is a separation claw.

16. A developing apparatus as claimed in claim 13, wherein the sleeve has a flexibility.

17. A developing apparatus as claimed in claim 13, wherein the sleeve is a rigid body.

18. A developing apparatus as claimed in claim 13, wherein said apparatus further comprises a cleaner for cleaning the roller surface of the drive roller.

19. A developing apparatus as claimed in claim 13, wherein the sleeve has an insulation layer on its inner surface.

20. A developing apparatus as claimed in claim 13, wherein the roller surface of the drive roller is charged plus and minus alternately.

21. A developing apparatus as claimed in claim 13, wherein the roller surface of the drive roller includes a non-charged region and a charged region of plus or minus alternately.

22. A developing apparatus comprising:

a sleeve rotation-feed apparatus comprising:

a drive roller having a roller surface formed by a material of a high resistance and a plurality of linear electrodes extending in axial direction of the roller and arranged in a circumferential direction, wherein every other electrode constitutes an electrode block electrically connected, thus obtaining two electrode blocks;

a power source for applying a potential difference between the two electrode blocks;

a separator arranged in the proximity of the drive roller; and a sleeve arranged so as to surround the drive roller and the separator in such a manner that a portion of the sleeve is in contact with the drive roller, wherein the separator separates the sleeve from the drive roller, wherein the electrode blocks of the drive roller are used to absorb a portion of the sleeve to a portion of the roller surface, so as to be fed;

a toner supplier for supplying toner to a surface of the sleeve; and a doctor blade for regulating a toner layer.

23. A developing apparatus as claimed in claim 22, wherein the separator is a rotatable separation roller.

24. A developing apparatus as claimed in claim 22, wherein the separator is a separation claw.

25. A developing apparatus as claimed in claim 22, wherein the sleeve has a flexibility.

26. A developing apparatus as claimed in claim 22, wherein the sleeve is a rigid body.

27. A developing apparatus as claimed in claim 22, wherein said apparatus further comprises a cleaner for cleaning the roller surface of the drive roller.

28. A developing apparatus as claimed in claim 22, wherein the sleeve has an insulation layer on its inner surface.

29. An image formation apparatus comprising:

a sleeve rotation-feed apparatus including:

a drive roller in which at least a portion of the roller surface is a dielectric layer;

an electric charger for charging the roller surface of the drive roller;

a power source for applying a potential difference between the roller surface of the drive roller and the electric charger;

a separator arranged in the proximity of the drive roller; and a sleeve arranged so as to surround the drive roller, the electric charger, and the separator in such a manner that a portion of the sleeve is in contact with the drive roller, the sleeve having a photosensitive layer on its outer surface, wherein the separator separates the sleeve from the drive roller, wherein the dielectric layer of the drive roller is used to absorb a portion of the sleeve to a portion of the roller surface, so as to be fed.

30. An image formation apparatus as claimed in claim 29, wherein the separator is a rotatable separation roller.

31. An image formation apparatus as claimed in claim 29, wherein the separator is a separation claw.

32. An image formation apparatus as claimed in claim 29, wherein the sleeve has a flexibility.

33. An image formation apparatus as claimed in claim 29, wherein the sleeve is a rigid body.

34. An image formation apparatus as claimed in claim 29, wherein said apparatus further comprises a cleaner for cleaning the roller surface of the drive roller.

35. An image formation apparatus as claimed in claim 29, wherein the sleeve has a portion not in contact with the drive roller and in contact with or in the proximity of a developing roller.

36. An image formation apparatus as claimed in claim 29, wherein the sleeve has a portion which is not in contact with the drive roller and which is in contact with a recording medium, a transfer medium, or a transfer roller.

37. An image formation apparatus as claimed in claim 29, wherein the sleeve has an insulation layer on its inner surface.

38. An image formation apparatus as claimed in claim 29, wherein the roller surface of the drive roller is charged plus and minus alternately.

39. An image formation apparatus as claimed in claim 29, wherein the roller surface of the drive roller includes a non-charged region and a charged region of plus or minus alternately.

40. An image formation apparatus comprising:

a sleeve rotation-feed apparatus including:

a drive roller having a roller surface formed by a material of a high resistance and a plurality of linear electrodes extending in an axial direction of the roller and arranged in a circumferential direction, wherein every other electrode constitutes an electrode block electrically connected, thus obtaining two electrode blocks;

a power source for applying a potential difference between the two electrode blocks;

a separator arranged in the proximity of the drive roller; and a sleeve arranged so as to surround the drive roller and the separator in such a manner that a portion of the sleeve is in contact with the drive roller, the sleeve having a photosensitive layer on its outer surface, wherein the separator separates the sleeve from the drive roller, wherein the electrode blocks of the drive roller are used to absorb a portion of the sleeve to a portion of the roller surface, so as to be fed.

41. An image formation apparatus as claimed in claim 40, wherein the separator is a rotatable separation roller.

42. An image formation apparatus as claimed in claim 40, wherein the separator is a separation claw.

43. An image formation apparatus as claimed in claim 40, wherein the sleeve has a flexibility.

44. An image formation apparatus as claimed in claim 40, wherein the sleeve is a rigid body.

45. An image formation apparatus as claimed in claim 40, wherein said apparatus further comprises a cleaner for cleaning the roller surface of the drive roller.

46. An image formation apparatus as claimed in claim 40, wherein the sleeve has a portion not in contact with the drive roller and in contact with or in the proximity of a developing roller.

47. An image formation apparatus as claimed in claim 40, wherein the sleeve has a portion which is not in contact with the drive roller and which is in contact with a recording medium, a transfer medium, or a transfer roller.

48. An image formation apparatus as claimed in claim 40, wherein the sleeve has an insulation layer on its inner surface.

49. A fixation apparatus comprising:

a sleeve rotation-feed apparatus including:

a drive roller in which at least a portion of the roller surface is a dielectric layer;

a heater arranged in the drive roller for heating the roller surface of the drive roller;

an electric charger for charging the roller surface of the drive roller;

a power source for applying a potential difference between the roller surface of the drive roller and the electric charger;

a separator arranged in the proximity of the drive roller; and a sleeve arranged so as to surround the drive roller, the electric charger, and the separator in such a manner that a portion of the sleeve is in contact with the drive roller, wherein the separator separates the sleeve from the drive roller, wherein the dielectric layer of the drive roller is used to absorb a portion of the sleeve to a portion of the roller surface, so as to be fed.

50. A fixation apparatus as claimed in claim 49, wherein the apparatus further comprising a cooling roller arranged at an opposing position to the sleeve so as to sandwich a recording medium where the sleeve is not in contact with the drive roller.

51. A fixation apparatus as claimed in claim 49, wherein the sleeve has an insulation layer on its inner surface.

52. A fixation apparatus as claimed in claim 49, wherein the roller surface of the drive roller is charged plus and minus alternately.

53. A fixation apparatus as claimed in claim 49, wherein the roller surface of the drive roller includes a non-charged region and a charged region of plus or minus alternately.

54. A fixation apparatus comprising:

a sleeve rotation-feed apparatus including:

a drive roller having a roller surface formed by a material of a high resistance and a plurality of linear electrodes extending in an axial direction of the roller and arranged in a circumferential direction, wherein every other electrode constitutes an electrode block electrically connected, thus obtaining two electrode blocks;

a power source for applying a potential difference between the two electrode blocks;

a separator arranged in the proximity of the drive roller; and a sleeve arranged so as to surround the drive roller and the separator in such a manner that a portion of the sleeve is in contact with the drive roller, wherein the separator separates the sleeve from the drive roller, wherein the electrode blocks of the drive roller are used to absorb a portion of the sleeve to a portion of the roller surface, so as to be fed.

55. A fixation apparatus as claimed in claim 54, wherein the apparatus further comprising a cooling roller arranged at an opposing position to the sleeve so as to sandwich a recording medium where the sleeve is not in contact with the drive roller.

56. A fixation apparatus as claimed in claim 54, wherein the sleeve has an insulation layer on its inner surface.

* * * * *